US010427429B2

(12) United States Patent
Godard

(10) Patent No.: US 10,427,429 B2
(45) Date of Patent: Oct. 1, 2019

(54) METHOD FOR PROTECTING PRINTED DATA

(71) Applicant: EVOLIS, Beaucouzé (FR)

(72) Inventor: Didier Godard, Beaucouzé (FR)

(73) Assignee: EVOLIS, Beaucouzé (FR)

( * ) Notice: Subject to any disclaimer, the term of this patent is extended or adjusted under 35 U.S.C. 154(b) by 0 days.

(21) Appl. No.: 16/087,726

(22) PCT Filed: Mar. 20, 2017

(86) PCT No.: PCT/EP2017/056588
§ 371 (c)(1),
(2) Date: Sep. 24, 2018

(87) PCT Pub. No.: WO2017/162601
PCT Pub. Date: Sep. 28, 2017

(65) Prior Publication Data

US 2019/0084322 A1 Mar. 21, 2019

(30) Foreign Application Priority Data

Mar. 25, 2016 (FR) ..... 16 52622

(51) Int. Cl.
*B41J 13/12* (2006.01)
*B41M 5/382* (2006.01)
(Continued)

(52) U.S. Cl.
CPC ..... *B41J 13/12* (2013.01); *B41J 2/325* (2013.01); *B41J 17/02* (2013.01); *B41M 5/38207* (2013.01); *B41M 5/38221* (2013.01)

(58) Field of Classification Search
CPC ... B41J 31/08; B41J 31/06; B41J 31/05; B41J 31/04; B41J 31/02; B41J 31/00;
(Continued)

(56) References Cited

U.S. PATENT DOCUMENTS

2004/0109715 A1* 6/2004 Meier ..... B41J 2/17546 400/191
2008/0219735 A1* 9/2008 Hoffman ..... B41J 13/12 400/58
(Continued)

FOREIGN PATENT DOCUMENTS

| | | | |
|---|---|---|---|
| FR | 2988509 | A1 | 9/2013 |
| JP | S6161877 | A | 3/1986 |
| JP | 2002211064 | A | 7/2002 |

OTHER PUBLICATIONS

Written Opinion in corresponding PCT Application No. PCT/EP20171056588, dated Jul. 3, 2017 (an English translation attached hereto).
(Continued)

*Primary Examiner* — Kristal Feggins
(74) *Attorney, Agent, or Firm* — LEASON ELLIS LLP

(57) ABSTRACT

The invention relates to a method (400) for protecting printed data on a transfer film of a heat-transfer printer for a plastic card comprising a print head (112), the protection method (400) comprising:

Figure 1:
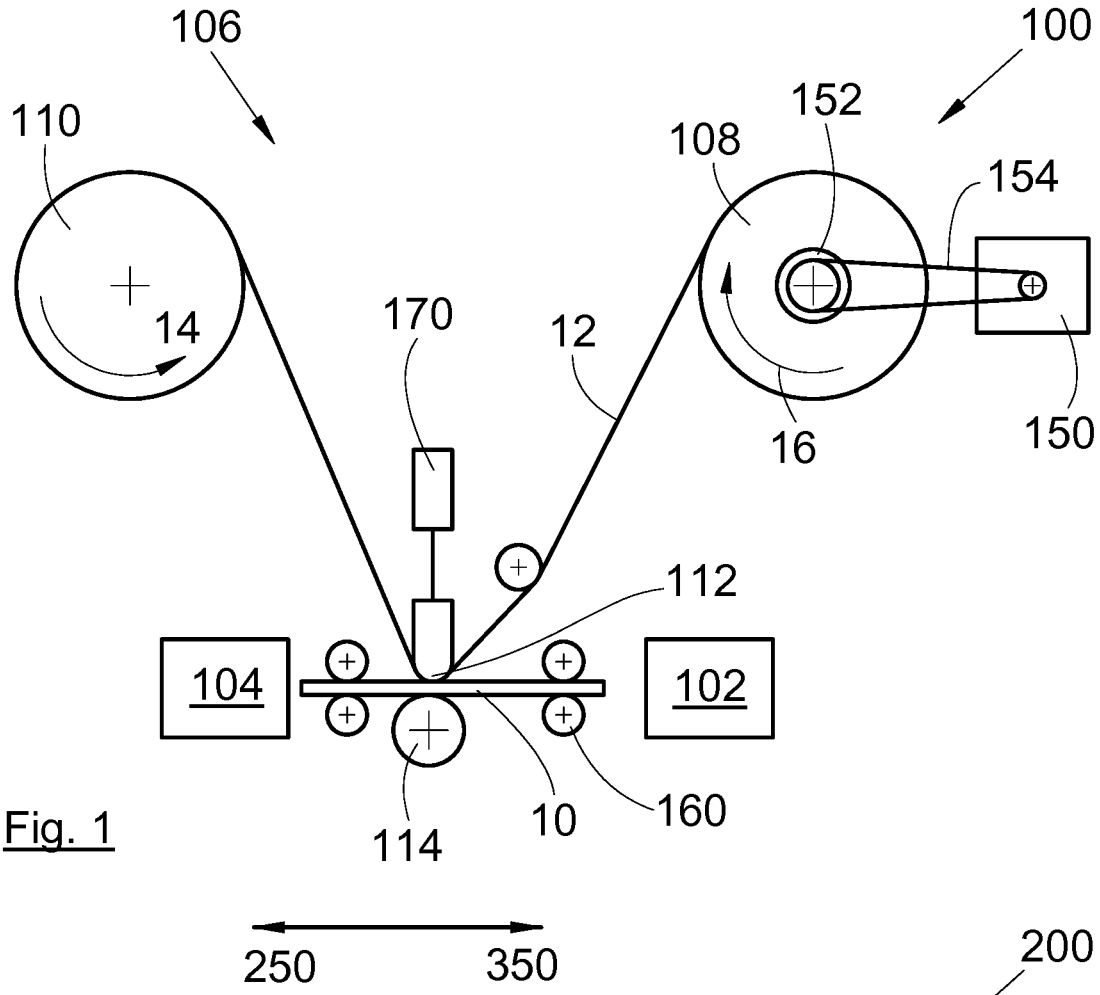

a first printing step (402) during which the transfer film and the plastic card advance simultaneously over a printing length $L_0$ under the print head and during which the print head heats according to the text to be printed, a rewinding step (404) during which the transfer film is rewound over a rewinding length $L_0$+/−d different from the printing length $L_0$, and during which the plastic card is brought upstream of the print head, a subsequent printing step (408) during which the transfer film and the plastic card (10) advance simultaneously over another printing length under the print head and during which the print head heats according to the text to be printed, and (Continued)

an ejection step (410) during which the plastic card is expelled from the printer.

6 Claims, 3 Drawing Sheets

(51) Int. Cl.
*B41J 2/325* (2006.01)
*B41J 17/02* (2006.01)

(58) Field of Classification Search
CPC ... B41J 33/00; B41J 33/14; B41J 33/16; B41J 33/18; B41J 2/33; B41J 2/325; B41J 2/32; B41J 13/12; B41J 17/02; B41M 5/38207; B41M 5/38221
See application file for complete search history.

(56) References Cited

U.S. PATENT DOCUMENTS

| | | | | |
|---|---|---|---|---|
| 2014/0132967 | A1 | 5/2014 | Higashi et al. | |
| 2017/0106665 | A1* | 4/2017 | Cronin | B41J 33/44 |
| 2017/0182812 | A1* | 6/2017 | Sasaki | B41J 2/325 |

OTHER PUBLICATIONS

International Search Report in corresponding PCT Application No. PCT/EP2017/056588, dated Jul. 3, 2017 (an English translation attached hereto).

* cited by examiner

METHOD FOR PROTECTING PRINTED DATA

CROSS-REFERENCE TO RELATED PATENT APPLICATIONS

This application is a U.S. National Stage Application under 35 U.S.C. § 371 of International Patent Application No. PCT/EP2017/056588, filed Mar. 20, 2017, which claims the benefit of priority under 35 U.S.C. Section 119(e) of French Patent Application number 1652622 filed Mar. 25, 2016, both of which are incorporated by reference in their entireties. The International Application was published on Sep. 28, 2017, as International Publication No. WO 2017/162601 A1.

The present invention relates to a method for protecting printed data, as well as a printer implementing such a method.

A heat-transfer printer, more particularly a printer for printing plastic cards by heat transfer, comprises:

- a feed system that supplies the printer with a blank plastic card, this feed system may be a card-by-card feed system or a reservoir of a plurality of cards provided with a card-separation system,
- an ejection system that ejects each plastic card from the printer after printing, and
- between the feed system and the ejection system, a print module for printing on the plastic card.

The print module comprises:

- a feed roller on which a transfer film carrying a layer of ink to be deposited is wound,
- a recovery roller on which the transfer film is wound after the layer of ink has been applied to the plastic card,
- a print head between the feed roller and the recovery roller, and
- a backing roller disposed against the print head.

The transfer film is positioned between the plastic card and the print head.

When a plastic card is to be printed, the transfer film and the plastic card to be printed are synchronised with respect to the print head so that said plastic card and a blank area of the transfer film are presented simultaneously at the print head. The synchronisation takes place for example by means of position detectors that detect among other things the front edge of the plastic card when the plastic card advances towards the print head.

During printing, the print head heats the transfer film according to the characters to be printed, which causes the transfer of the ink from the transfer film onto the plastic card. As the printing continues, the plastic card and the transfer film advance simultaneously under the print head in order to print the plastic card, and the transfer film winds progressively onto the recovery roller.

The characters that have been printed on the plastic card are then in negative on the transfer film. By recovering the transfer film wound on the recovery roller, it is then possible to find the data that have been printed, which is unsatisfactory from the confidentiality point of view.

One object of the present invention is to propose a protection method that protects the data that are situated on the transfer film after printing.

To this end, there is proposed a method for protecting printed data on a transfer film of a heat-transfer printer for a plastic card comprising a print head, the protection method comprising:

- a first printing step during which the transfer film and the plastic card advance simultaneously over a printing length $L_0$ under the print head and during which the print head heats according to the text to be printed,
- a rewinding step during which the transfer film is rewound over a rewinding length $L_0$+/−d different from the printing length $L_0$, and during which the plastic card is brought upstream of the print head,
- a subsequent printing step during which the transfer film and the plastic card advance simultaneously over another printing length under the print head and during which the print head heats according to the text to be printed, and
- an ejection step during which the plastic card is expelled from the printer.

Advantageously, the protection method comprises a looping step during which the subsequent print step loops back onto the rewinding step.

Advantageously, the protection method comprises, between the rewinding step and the subsequent printing step, a formatting step during which, if the rewinding length is less than the previous printing length, the part of the original text that extends at the end of the text over a length equal to the difference between the printing length and the rewinding length is omitted and, if the rewinding length is greater than the printing length, the part of the original text that extends at the start of the text over a length equal to the difference between the rewinding length and the printing length is omitted.

Advantageously, the first printing step is accompanied by a counting substep during which the number $N_0$ of pulses generated during the first printing is counted, and during which a number of pulses corresponding to the rewinding length is calculated, and the rewinding step is accompanied by a counting substep during which the number of pulses generated during the rewinding is counted and during which the rewinding stops when said number of pulses has reached the number of pulses corresponding to the rewinding length calculated previously.

The invention also proposes a heat-transfer printer comprising:

- a feed system for supplying the printer with a plastic card,
- a feed roller on which a transfer film carrying a layer of ink to be deposited is wound,
- a recovery roller on which the transfer film is wound after the layer of ink has been applied to a plastic card,
- a print head between the feed roller and the recovery roller,
- an ejection system for ejecting the plastic card from the printer after printing, and
- a processor arranged to:
  - control the simultaneous advance, over a printing length $L_0$, of the transfer film and of the plastic card under the print head and the heating of the print head according to the text to be printed,
  - controlling the rewinding of the transfer film over a rewinding length $L_0$+/−d different from the printing length $L_0$, and the return of the plastic card upstream of the print head,
  - controlling the simultaneous advance, over another printing length, of the transfer film and of the plastic card under the print head and the heating of the print head according to the text to be printed, and
  - controlling the advance of the plastic card as far as the ejection system.

Advantageously, the processor is arranged so as, if the rewinding length is less than the previous printing length, to omit the part of the original text that extends at the end of the text over a length equal to the difference between the printing length and the rewinding length, and, if the rewinding length is greater than the printing length, to omit the part of the original text that extends at the start of the text over a length equal to the difference between the rewinding length and the printing length.

Figure 2:
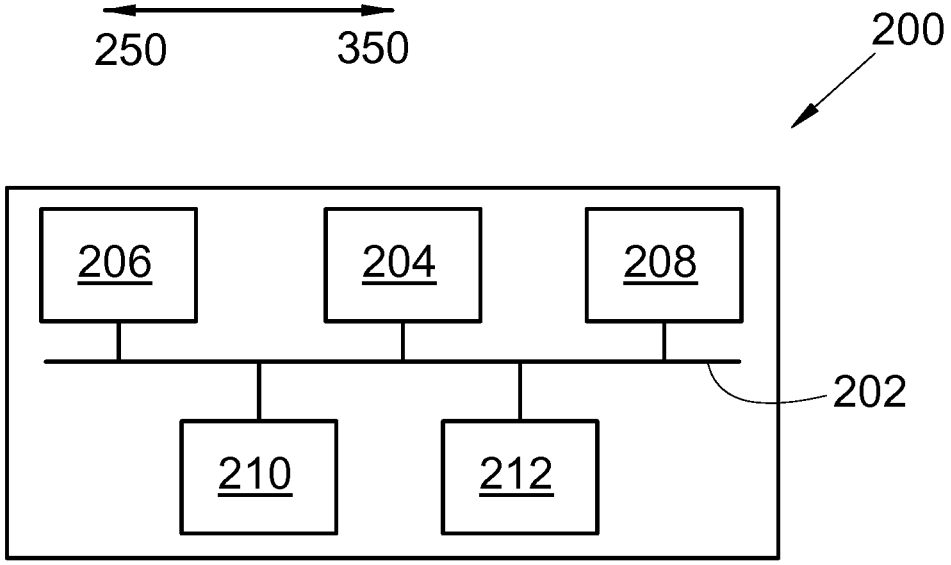
Figure 3:
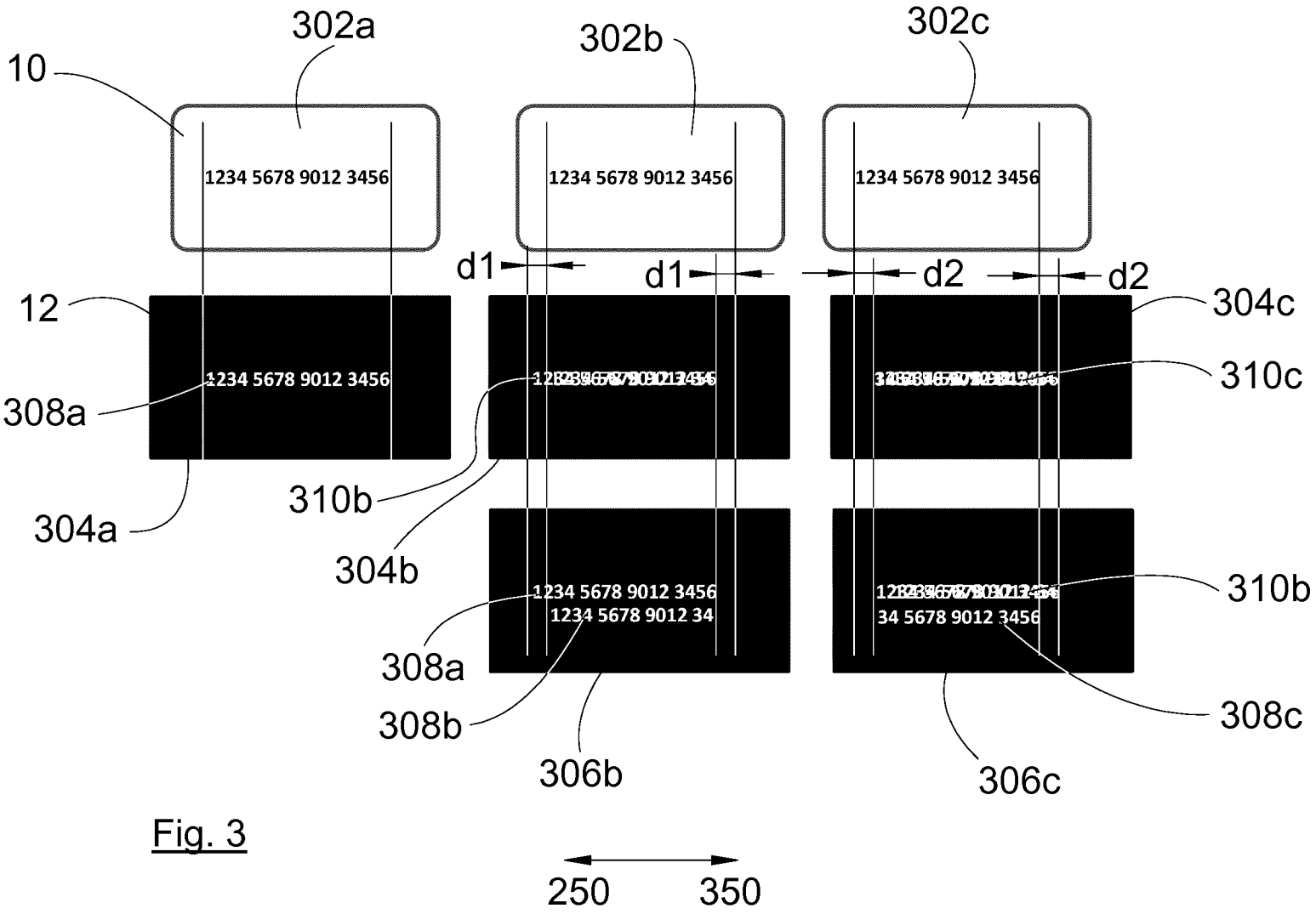
Figure 4:
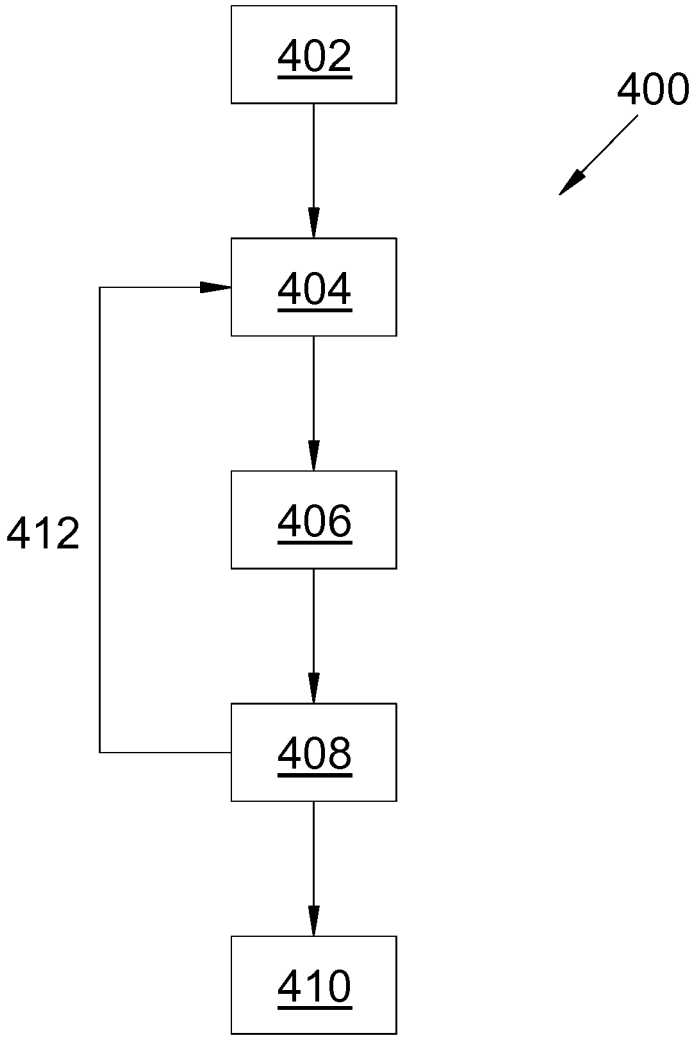

The features of the invention mentioned above, as well as others, will emerge more clearly from a reading of the following description of an example embodiment, said description being given in relation to the accompanying drawings, among which:

FIG. 1 is a schematic representation of a printer according to the invention, FIG. 2 shows an architecture of a control unit of the printer according to the invention, FIG. 3 is a representation of printed elements during the printing of a plastic card, and FIG. 4 shows an algorithm of a protection method according to the invention.

FIG. 1 shows a printer 100 that prints by heat transfer on a plastic card 10. The printer 100 comprises:

- a feed system 102 that supplies the printer 100 with a blank plastic card 10, this feed system 102 may be a card-by-card feed system or a reservoir of a plurality of cards provided with a card separation system,
- an ejection system 104 that ejects each plastic card 10 from the printer 100 after printing, and
- between the feed system 102 and the ejection system 104, a print module 106 for printing the plastic card 10.

The feed system 102 and the ejection system 104 are not described any further since all types of known systems using motorised drive rollers can be used.

The print module 106 comprises:

- a feed roller 108 on which a transfer film 12 carrying a layer of ink to be deposited is wound,
- a recovery roller 110 on which the transfer film 12 is wound after the layer of ink has been applied to the plastic card 10,
- a print head 112 between the feed roller 108 and the recovery roller 110, and
- a backing roller 114 disposed against the print head 112 in order to press the plastic card 10 against the print head 112.

The transfer film 12 is positioned between the plastic card 10 and the print head 112.

The general principle of operation of the printer 100 is identical to the operating principle of a printer of the prior art. A plastic card 10 is captured by the feed system 102 and driven towards the print head 112, which heats the transfer film 12 according to the data to be printed, and then, when the data are printed on the plastic card 10, the plastic card 10 is taken up by the ejection system 104, which ejects the plastic card from the printer 100. The plastic card 10 and the transfer film 12 both move in the same printing direction 250.

Conventionally, when the plastic card 10 is to be printed, it is synchronised, with respect to the print head 112, with an area of the transfer film 12 that is blank, that is to say that has not yet passed under the print head 112.

The transfer film 12 is driven during printing by a motor with which the recovery roller 110 is equipped and which drives said recovery roller 110 in a direction 14 of winding of the transfer film 10 onto the recovery roller 110.

In the context of the invention, the printer 100 also comprises a rewinding motor 150 that is designed to drive the feed roller 108 in a direction 16 of winding the transfer film 10 onto the feed roller 108. The transfer film 12 is then driven in the opposite direction to the printing direction 250. The rewinding motor 150 here acts by means of a belt 154 installed between the shaft of the rewinding motor 150 and the shaft of the feed roller 108.

The printer 100 also comprises an angular coder 152 mounted on the feed roller 108 and which counts the number of degrees through which the feed roller 108 turns during printing. This angular coder 152 may take various forms such as for example a set of fixed teeth or holes on the feed roller 108 and disposed on the periphery of a circle coaxial with the rotation axis of the feed roller 108, and an optical sensor that counts the number of teeth or holes passing in front of it during printing. This angular coder 152 may also be a magnetic coder. The angular coder 152 conventionally delivers information relating to the number of pulses generated during the rotation, the pulses are generated by magnetic or optical elements as described above.

The printer 100 also comprises movement means 160 for moving the plastic card 10 with respect to the print head 112, from upstream to downstream (the printing direction 250) and vice versa. The movement means 160 are here in the form of rollers that are in abutment against the top face and bottom face of the plastic card 10 and comprise a motor designed to drive the rollers in one direction or the other. Thus, according to the direction of rotation of the rollers, the plastic card 10 moves from the feed system 102 towards the ejection system 104 (the printing direction 250) or vice versa. These or some of these rollers may form part of the feed system 102 and of the ejection system 104 according to their positions with respect to the print head 112.

FIG. 2 shows a control unit 200 of the printer 100. The control unit 200 comprises, connected by a communication bus 202: a processor 204 or CPU (central processing unit), a random access memory RAM 206, a read only memory ROM 208, at least one communication interface 210 of the input/output type, enabling the control unit 200 to communicate with the various motors, the print head 112 and the various sensors of the printer 100, and optionally a storage unit 212 such as a hard disk or a storage medium reader, such as an SD (secure digital) card reader.

The processor 204 is capable of executing instructions loaded into the RAM 206 from the ROM 208, from an external memory (not shown), from a storage medium (such as an SD card), or from a communication network. When the printer 100 is powered up, the processor 204 is capable of reading instructions from the RAM 206 and executing them. These instructions form a computer program causing the implementation by the processor 204 of all or some of the algorithms and steps described below.

All or some of the algorithms and steps described below can be implemented in software form by the execution of a set of instructions by a programmable machine, for example a DSP (digital signal processor) or a microcontroller, or be implemented in hardware form by a machine or a dedicated component, for example an FPGA (field-programmable gate array) or an ASIC (application-specific integrated circuit).

FIG. 3 shows examples of printings that are carried out during the printing of a plastic card 10 by the printer 100.

The elements bearing the references 302*a-c* represent the plastic card 10 on which the text to be printed is printed at various printing stages.

The elements bearing the references 304*a-c* represent the transfer film 12 with the part of the ink that has disappeared following printing.

The elements bearing the references 306*b-c* show the transfer film 12 on which one of the printings has been notionally offset transversely with respect to the printing direction 250 in order to facilitate understanding of the invention.

When the plastic card 10 passes under the print head 112, it is printed (302*a*) a first time with the data transmitted by the processor 204 to the print head 112. In the example, the data are the text "1234 5678 9012 3456". At the same time, the ink corresponding to the text is removed from the transfer film 12 and the text appears in negative (304*a*). Following this first printing, the text appears in clear on the transfer film 12 on the line 308*a*.

Following the first printing, the plastic card 10 is repositioned upstream of the print head 112 by the movement means 160 by movement in a direction 350 opposite to the printing direction 250. In the same way, the transfer film 12 is rewound in the reverse direction 350 on the feed roller 108 by the rewinding motor 150. The rewinding takes place with an offset $d_1$ in one direction or the other with respect to the reverse direction 350 (here the offset is in the direction of the printing direction 250, that is to say the transfer film 12 has been rewound less than what was necessary to achieve the first printing). The same plastic card 10 is then synchronised with respect to the print head 112 for a new printing of the same text or a part of the same text.

The printing, in the printing direction 250, of the new text line is done on the plastic card 10, and the new text line is superimposed on the text line already printed on the plastic card 10 (302*b*).

The line 308*b* represents the ink line that disappeared from the transfer film 12 during printing, it appears in negative.

Without the notional offset applied between the lines 308*a* and 308*b*, the lines 308*a-b* are superimposed in a line 310*b* that represents what actually appears on the transfer film 12, which is then illegible.

According to a particular embodiment, in order to avoid consuming the part of the transfer film 12 at the end of the text, the characters (here 5 and 6) that are offset are deleted by the processor 204, here over a length corresponding to the offset $d_1$. Furthermore, such a deletion reinforces the illegibility of the text, in particular of the end of the text.

Following the second printing, the plastic card 10 is repositioned upstream of the print head 112 by the movement means 160 by movement in a direction 350 opposite to the printing direction 250. In the same way, the transfer film 12 is rewound in the reverse direction 350 on the feed roller 108 by the rewinding motor 150. The rewinding takes place with an offset $d_2$ in one direction or the other with respect to the reverse direction 350 (here the offset is in the direction of the reverse direction 350, that is to say the transfer film 12 has been rewound more than what was necessary to achieve the second printing). The same plastic card 10 is then synchronised with respect to the print head 112 for a new printing of the same text or of a part of the same text.

The printing, in the printing direction 250, of the new text line takes place on the plastic card 10, the new text line is superimposed on the text already printed on the plastic card 10 (302*c*).

The line 308*c* represents the ink line that disappeared from the transfer film 12 during printing, it appears in negative.

Without the notional offset applied between the lines 310*b* and 308*c*, the lines 310*b* and 308*c* are superimposed in a line 310*c* that represents what actually appears on the transfer film 12, which is then even more illegible.

In this case also, the characters (here 1 and 2) that are offset before the start of the text can be deleted by the processor 204, here over a length corresponding to the offset $d_2$, in order to reinforce the illegibility of the text, in particular of the start of the text.

In the example embodiment presented here, there are two offsets $d_1$ and $d_2$, but there could be more of them, even if at least one offset printing is sufficient, a larger number makes the text more illegible.

In the same way, there is an offset $d_1$ in one direction followed by an offset $d_2$ in the other direction, but they may both be in the same direction.

The amount of each offset $d_1$, $d_2$ must be sufficiently small to avoid an excessively large part of the text remaining legible. For example, in the case of the line 310*b*, the offset $d_1$ is around two characters, which preserves the legibility of the first two characters. Each offset preferably lies between a width of 0.5 characters and a width of 2.5 characters, which correspond substantially to a width of between 1.5 and 7.5 mm for characters with a height of 3 mm and a 3 mm spacing, such as the OCR-A extended size 14 font. Naturally, according to the size of the characters, a different offset may be used.

In the same way, each offset $d_1$, $d_2$ may be a value predefined at the time of construction, or a value generated by the processor 204 at each printing according to the height of the characters or any other variables.

In general terms, each length is obtained after a certain number of pulses of the motor that make it possible to obtain this length. The length of the movement due to one pulse of a motor is known by design, and depends among other things on the motor, the gearing between the motor and the roller, and the diameter of the roller that drives the plastic card 10 or the transfer film 12.

In order best to position the transfer film 12, it is preferable to take into account the diameter of the transfer film 12 on the feed roller 108. Thus, during various printings of the text, the processor 204 receives information from the angular coder 152, this information, which conventionally corresponds to a number of pulses, represents the number of degrees made by the feed roller 108 during printing. The processor 204 can then calculate the ratio between the number of pulses $N_0$ and the length $L_0$ of transfer film 12 that has been unwound to print the text for the first time, this ratio makes it possible to take account of the diameter of the transfer film 12 on the feed roller 108 since the number of pulses for a length varies according to said diameter. The length $L_0$ is preferably greater than or equal to the length of the text to be printed, in particular the length $L_0$ is sufficient to pass at least the entire plastic card 10 under the print head 112.

The processor 204 can then determine the number of pulses corresponding to the lengths of the offsets $d_1$ and $d_2$, which are respectively $$d_1 * \frac{N_0}{L_0} \text{ and } d_2 * \frac{N_0}{L_0}.$$

The processor 204 then controls the rewinding motor 150 so as to rewind the transfer film 12 while counting the number of pulses generated by the angular coder 152 and stops the rewinding motor 150 when the number of pulses thus counted is equal according to circumstances to $$N_0 - d_1 * \frac{N_0}{L_0} \text{ or } N_0 + d_2 * \frac{N_0}{L_0}.$$

Preferentially, in order to facilitate the rewinding of the transfer film 12, the print head 112 is raised and therefore separated from the plastic card 10 before rewinding and is lowered at the end of rewinding. To do this, the printer 100 has an elevator 170 to which the print head 112 is fixed and which is arranged to raise and lower the print head 112. The elevator 170 controlled by the processor 204 can take various forms such as for example a motor with a cam, a solenoid, etc.

To prevent the rotation of the feed roller 108 during printing generating forces on the rewinding motor 150, it is preferable to fit a clutch between the rewinding motor 150 and the feed roller 108. This clutch is arranged to transmit a force from the rewinding motor 150 to the feed roller 108 and to prevent the transmission of forces from the feed roller 108 to the rewinding motor 150. This clutch may be electric and controlled by the processor 204 or be mechanical of the clutch spring type.

FIG. 4 shows an algorithm of a method 400 for protecting the data printed by the printer 100, the protection method 400 comprises:

- a first printing step 402 during which the processor 204 controls the simultaneous advance, over a printing length $L_0$, of the transfer film 12 and of the plastic card 10 under the print head 112 and the heating of the print head 112 according to the text to be printed,
- a rewinding step 404 during which the processor 204 controls the rewinding of the transfer film 12 over a rewinding length $L_0$+/−d different from the printing length $L_0$, and the return of the plastic card 10 upstream of the print head 112, and
- a subsequent printing step 408 during which the processor 204 controls the simultaneous advance, over another printing length, of the transfer film 12 and of the plastic card 10 under the print head 112 and the heating of the print head 112 according to the text to be printed.

The advance of the transfer film 12 during the first printing step 402 and the subsequent printing step 408 is done by the motor associated with the recovery roller 110, which is controlled by the processor 204. In the same way, the simultaneous advance of the plastic card 10 during the first printing step 402 and the subsequent printing step 408 is done by the motor of the movement means 160, which is controlled by the processor 204.

The rewinding of the transfer film 12 is done by the rewinding motor 150, which is controlled by the processor 204. In the same way, the return of the plastic card 10 during the rewinding step 404 is done by the motor of the movement means 160, which is controlled by the processor 204.

Such a method makes it possible to offset at each printing the text that is in negative on the transfer film 12, so that the same text is superimposed at least twice offset in the printing direction 250.

Following a subsequent printing step 408, the process can continue with an ejection step 410 during which the processor 204 controls the advance of the plastic card 10 as far as the ejection system 104, where the plastic card 10 is expelled from the printer 100.

As described above, following the subsequent printing step 408, the process can loop back (412) onto the rewinding step 404 in order to perform a new subsequent printing step 408 with a different offset. The number of loops 412 can be parameterised in the processor 204, for example according to a degree of confidentiality to be achieved.

In the case of the card 302*b*, the rewinding length is equal to $L_0$-$d_1$ and the other printing length is at least equal to $L_0$-$d_1$. This length varies in particular depending on whether the last two characters are kept or removed, and depending on whether another subsequent printing is carried out or whether the plastic card 10 is ejected.

In general terms, the other printing length varies according to the offset applied, depending on whether or not the plastic card 10 is ejected. As with $L_0$, the other printing length is preferably sufficient to pass at least the whole of the plastic card 10 under the print head 112.

The rewinding length will be determined by the processor 204 so that there is superimposition of the printings on the transfer film 12. In the case of the card 302*c*, the transfer film 12 was rewound by a length $L_0$ with respect to its previous position (302*b*). The new other printing length also depends on this new rewinding length and the ejection or not of the plastic card 10.

As described above, it is possible to modify the text between two printings. In general terms, when the offset $d_1$ is in the direction of the printing direction 250, the processor 204 deletes the part of the text that extends at the end of the text over a length equal to the offset $d_1$ and when the offset $d_2$ is in the opposite direction to the printing direction 250, the processor 204 deletes the part of the text that extends at the part of the text over a length equal to the offset $d_2$.

The protection method 400 then comprises, between the rewinding step 404 and the subsequent printing step 408, a formatting step 406 during which, if the rewinding length is less than the previous printing length, the processor 204 deletes the part of the original text that extends at the end of the text over a length equal to the difference between the printing length and the rewinding length and, if the rewinding length is greater than the printing length, the processor 204 deletes the part of the original text that extends at the start of the text over a length equal to the difference between the rewinding length and the printing length, the text thus modified constitutes the text printed subsequently. This formatting step applies before each printing according to the offset applied and the various offsets previously applied.

As described above in order to take into account the diameter of the transfer film 12 on the feed roller 108, the first printing step 402 is accompanied by a counting substep during which the processor 204:

- counts the number $N_0$ of pulses generated by the angular coder 152 during the first printing, and
- calculates the number of pulses corresponding to the rewinding length, that is to say the printing length with the offset $$\left(N_0 - d_1 * \frac{N_0}{L_0}, N_0 + d_2 * \frac{N_0}{L_0}\right).$$

The rewinding step 404 is then accompanied by a counting substep during which the processor 204 counts the number of pulses generated by the angular coder 152 during the rewinding and stops the rewinding when said number of pulses has reached the number of pulses corresponding to the rewinding length calculated previously.

In the same way, for the other steps, the processor 204 takes into account these values for calculating the number of pulses to be counted in order to obtain the required length.

As specified above, between each printing step and each rewinding step, the protection method 400 comprises a raising step during which the processor 204 controls the raising of the print head 112, and, between each rewinding step and each printing head, the protection method 400 comprises a lowering step during which the processor 204 controls the lowering of the print head 112.

Before the first printing step 402, the protection method 400 conventionally comprises a feed step during which the processor 204 controls the feed system 102 in order to supply the print module 106 with a plastic card 10 to be printed.

Although the invention has in particular been presented in the case where the ink of the transfer film is completely transferred during the heating of the print head, it also applies in the case of printing by sublimation, where the quantity of ink of the transfer film that is transferred depends on the temperature of the print head.

The invention claimed is:

1. Method (400) for protecting printed data on a transfer film (12) of a heat-transfer printer (100) for a plastic card (10) comprising a print head (112), the protection method (400) comprising:

a first printing step (402) during which the transfer film (12) and the plastic card (10) advance simultaneously over a printing length L0 under the print head (112) and during which the print head heats according to a text to be printed, a rewinding step (404) during which the transfer film (12) is rewound over a rewinding length L0+/−d different from the printing length L0, and during which the plastic card (10) is brought upstream of the print head (112), a subsequent printing step (408) during which the transfer film (12) and the plastic card (10) advance simultaneously over another printing length under the print head (112) and during which the print head (112) heats according to the text to be printed, and an ejection step (410) during which the plastic card (10) is expelled from the printer (100).

2. Protection method (400) according to claim 1, wherein it comprises a looping step (412) during which the subsequent print step (408) loops back onto the rewinding step (404).

3. Protection method (400) according to claim 1, wherein it comprises, between the rewinding step (404) and the subsequent printing step (408), a formatting step (406) during which, if the rewinding length is less than the previous printing length, the part of the original text that extends at the end of the text over a length equal to the difference between the printing length and the rewinding length is omitted and, if the rewinding length is greater than the printing length, the part of the original text that extends at the start of the text over a length equal to the difference between the rewinding length and the printing length is omitted.

4. Protection method (400) according to claim 1, wherein the first printing step (402) is accompanied by a counting substep during which the number N0 of pulses generated during the first printing is counted, and during which a number of pulses corresponding to the rewinding length is calculated, and wherein the rewinding step (404) is accompanied by a counting substep during which the number of pulses generated during the rewinding is counted and during which the rewinding stops when said number of pulses has reached the number of pulses corresponding to the rewinding length calculated previously.

5. Heat-transfer printer (100) comprising:

a feed system (102) for supplying the printer (100) with a plastic card (10), a feed roller (108) on which a transfer film (12) carrying a layer of ink to be deposited is wound, a recovery roller (110) on which the transfer film (12) is wound after the layer of ink has been applied to a plastic card (10), a print head (112) between the feed roller (108) and the recovery roller (110), an ejection system (104) for ejecting the plastic card (10) from the printer (100) after printing, and a processor (204) arranged to:

control the simultaneous advance, over a printing length L0, of the transfer film (12) and of the plastic card (10) under the print head (112) and the heating of the print head (112) according to the text to be printed, controlling the rewinding of the transfer film (12) over a rewinding length L0+/−d different from the printing length L0, and the return of the plastic card (10) upstream of the print head (112), controlling the simultaneous advance, over another printing length, of the transfer film (12) and of the plastic card (10) under the print head (112) and the heating of the print head (112) according to the text to be printed, and controlling the advance of the plastic card (10) as far as the ejection system (104).

6. Printer (100) according to claim 5, wherein the processor (204) is arranged so as, if the rewinding length is less than the previous printing length, to omit the part of the original text that extends at the end of the text over a length equal to the difference between the printing length and the rewinding length, and, if the rewinding length is greater than the printing length, to omit the part of the original text that extends at the start of the text over a length equal to the difference between the rewinding length and the printing length.

* * * * *